US006832664B2

(12) United States Patent
Stuart

(10) Patent No.: US 6,832,664 B2
(45) Date of Patent: Dec. 21, 2004

(54) CLAMPLESS HOSE RETAINER MECHANISM

(75) Inventor: Philip Edward Arthur Stuart, Chatham (CA)

(73) Assignee: Siemens VDO Automotive Inc., Chatham, CA (US)

( * ) Notice: Subject to any disclaimer, the term of this patent is extended or adjusted under 35 U.S.C. 154(b) by 372 days.

(21) Appl. No.: 09/838,472

(22) Filed: Apr. 19, 2001

(65) Prior Publication Data

US 2002/0043235 A1 Apr. 18, 2002

Related U.S. Application Data

(60) Provisional application No. 60/205,748, filed on May 19, 2000.

(51) Int. Cl.[7] ..... F01N 7/10

(52) U.S. Cl. ..... 181/240; 181/264; 181/269; 181/272; 181/273; 181/212; 123/184.53; 123/184.57

(58) Field of Search ..... 181/212, 268–276, 181/247–251, 255–258, 207, 224–232, 266, 240, 238, 259; 92/34–47; 285/49, 299; 60/323; 123/184.52, 184.53, 184.54, 184.55, 184.56, 184.57, 184.59, 184.61, 184.41, 184.21; 137/527; 180/68.1–68.3; 296/208

(56) References Cited

U.S. PATENT DOCUMENTS

| | | | | | |
|---|---|---|---|---|---|
| 2,323,955 | A | * | 7/1943 | Wilson | 181/229 |
| 4,206,600 | A | * | 6/1980 | Feuling | 60/312 |
| 4,350,223 | A | * | 9/1982 | Takei | 181/229 |
| 4,578,855 | A | * | 4/1986 | Van Der Hagen | 29/447 |
| 4,693,339 | A | * | 9/1987 | Beale et al. | 181/255 |
| 4,790,864 | A | * | 12/1988 | Kostun | 96/388 |
| 4,854,417 | A | * | 8/1989 | Uesugi et al. | 181/272 |
| 5,025,889 | A | * | 6/1991 | Lockwood et al. | 181/250 |
| 5,145,215 | A | * | 9/1992 | Udell | 285/49 |
| 5,167,430 | A | * | 12/1992 | Bainbridge | 285/53 |
| 5,214,254 | A | * | 5/1993 | Sheehan | 181/241 |
| 5,251,538 | A | * | 10/1993 | Smith | 92/34 |
| 5,302,783 | A | | 4/1994 | Sadr et al. | |
| 5,331,810 | A | * | 7/1994 | Ingermann et al. | 60/322 |
| 5,559,308 | A | * | 9/1996 | Hayashi | 181/265 |
| 5,606,857 | A | * | 3/1997 | Harada | 60/322 |
| 5,635,687 | A | * | 6/1997 | Biscaldi | 181/272 |
| 5,756,945 | A | * | 5/1998 | Maeda et al. | 181/272 |
| 5,823,157 | A | * | 10/1998 | Muramatsu | 123/184.56 |
| 5,826,553 | A | * | 10/1998 | Nakayama et al. | 123/184.42 |
| 5,900,595 | A | | 5/1999 | Akima et al. | |
| 5,917,161 | A | * | 6/1999 | Fuhrmann | 181/237 |
| 5,929,397 | A | * | 7/1999 | Satoh et al. | 181/229 |
| 6,035,633 | A | * | 3/2000 | Woods | 60/310 |
| 6,109,661 | A | * | 8/2000 | Cwik et al. | 285/45 |
| 6,116,376 | A | * | 9/2000 | Chu | 181/256 |

(List continued on next page.)

FOREIGN PATENT DOCUMENTS

| | | |
|---|---|---|
| EP | 0598696 | 5/1994 |
| EP | 0896148 | 2/1999 |

OTHER PUBLICATIONS

European Search Report dated Sep. 18, 2001.

*Primary Examiner*—David Martin
*Assistant Examiner*—Renata McCloud

(57) ABSTRACT

A rubber hose of an air supply assembly is secured to a resonator by an inserted internal tube. A tapered insertion end of the internal tube is inserted into the rubber hose and slides along an angled surface of the rubber hose. The tapered insertion end presses the rubber hose against a hose neck of the resonator to retain and seal the rubber hose. A retention end of the internal tube secures the tube to the resonator. The retention end includes a recessed portion positioned between a pair of flanges. The tube neck of the resonator engages the recessed portion, the flanges securing the internal tube in place.

24 Claims, 2 Drawing Sheets

U.S. PATENT DOCUMENTS 6,164,067 A * 12/2000 Cronje ..... 60/322
6,164,703 A * 12/2000 Kim ..... 285/49
6,178,939 B1 * 1/2001 Powell ..... 123/184.21
6,250,422 B1 * 6/2001 Goplen et al. ..... 181/272
6,354,632 B1 * 3/2002 Jung et al. ..... 285/49
6,510,920 B1 * 1/2003 Durand ..... 181/249
6,732,510 B2 * 5/2004 Ciray ..... 60/312

* cited by examiner

CLAMPLESS HOSE RETAINER MECHANISM

This application claims priority from provisional application Ser. No. 60/205,748 filed May 19, 2000.

BACKGROUND OF THE INVENTION

The present invention relates generally to a clampless hose retainer mechanism for use with an air supply assembly.

An air cleaner purifies and directs air into an inlet manifold and an internal combustion engine. As the air travels through the air cleaner assembly, noise is produced. A resonator is commonly employed in the air cleaner assembly to reduce the amount of noise produced. The resonator is commonly integrated into or attached proximate to the air cleaner.

As air passes through a tube positioned in the resonator, the air flows and passes through a plurality of tuning holes and slots, reducing the noise generated. After passing through the resonator and the tube, the air enters a rubber hose which connects to the inlet manifold. In the prior art, the rubber hose is attached to the resonator by an external metal clamp.

There are several drawbacks to utilizing an external metal clamp to connect the rubber hose to the air cleaner. For one, the external metal clamp is expensive. Additionally, as the metal clamp is external, it can be easily crushed, increasing the need for replacement. Finally, the metal clamp can corrode due to the underhood environment.

Hence, there is a need in the art for a clampless hose retainer mechanism for use with an air supply assembly.

SUMMARY OF THE INVENTION

The present invention relates generally to a clampless hose retainer mechanism for use with an air supply assembly.

A rubber hose of an air cleaner assembly is secured to a resonator by an internal tube inserted in the hose. In the preferred embodiment, the internal tube provides a tuning tube, as explained below. A first end of the rubber hose including an interior angled surface is inserted into a hose opening in a hose neck of a resonator. A tapered insertion end of the internal tube is inserted into the first end of the rubber hose. Since the first end of the rubber hose includes an angled surface, the tapered insertion end slides into the interior of the rubber hose. If necessary, a lubricant can be utilized. The tapered insertion end presses the rubber hose against the hose neck of the resonator, retaining and sealing the rubber hose.

The internal tube further includes a retention end. In the preferred embodiment, the retention end includes a recessed portion positioned between a pair of flanges. When the internal tube is positioned into a tube opening in the resonator, a tube neck substantially engages the recessed portion, the flanges securing the internal tube in place.

In another embodiment of the present invention, the rubber tube includes a plurality of seal beads positioned on the exterior surface of the rubber hose to assist in sealing.

Accordingly, the present invention provides a clampless hose retainer mechanism for use with an air supply assembly.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
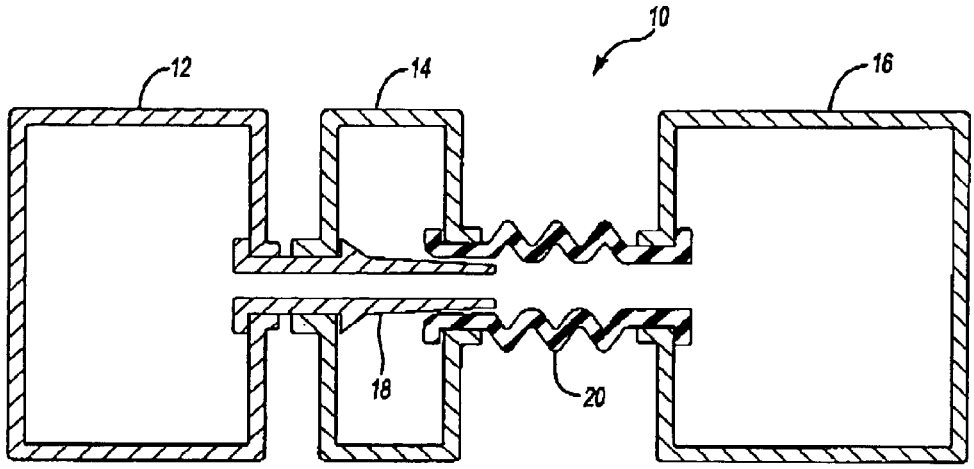
FIG. 1 illustrates an air supply assembly.

FIG. 1 illustrates an air supply assembly 10. The air supply assembly 10 includes an air cleaner 12, a resonator 14 and an inlet manifold 16. Noise is produced from the inlet manifold 16 and travels through the air cleaner assembly 10. A resonator 14, such as a Helmholtz resonator, is commonly employed to reduce the amount of noise passing out of the air supply assembly 10.

A rubber hose 20 connects the resonator 14 to the inlet manifold 16. An internal tube 18 positioned within the resonator 14 connects the air flow from the air cleaner 12, through the resonator 14, and into the rubber hose 20. In the preferred embodiment, the internal tube 18 is a tuning tube and includes a plurality of tuning holes or slots 22 (illustrated in FIG. 2). The tuning holes/slots 22 and chamber 23 providing the resonator function. Thus, the noise is reduced. The positioning and the number of tuning holes and slots 22 in the internal tube 18 together with the required chamber 23 allow for the desired tuning of the resonator 14. Alternatively, the internal tube 18 is not a part of the resonator 14 and is part of the air cleaner 12

Figure 2:
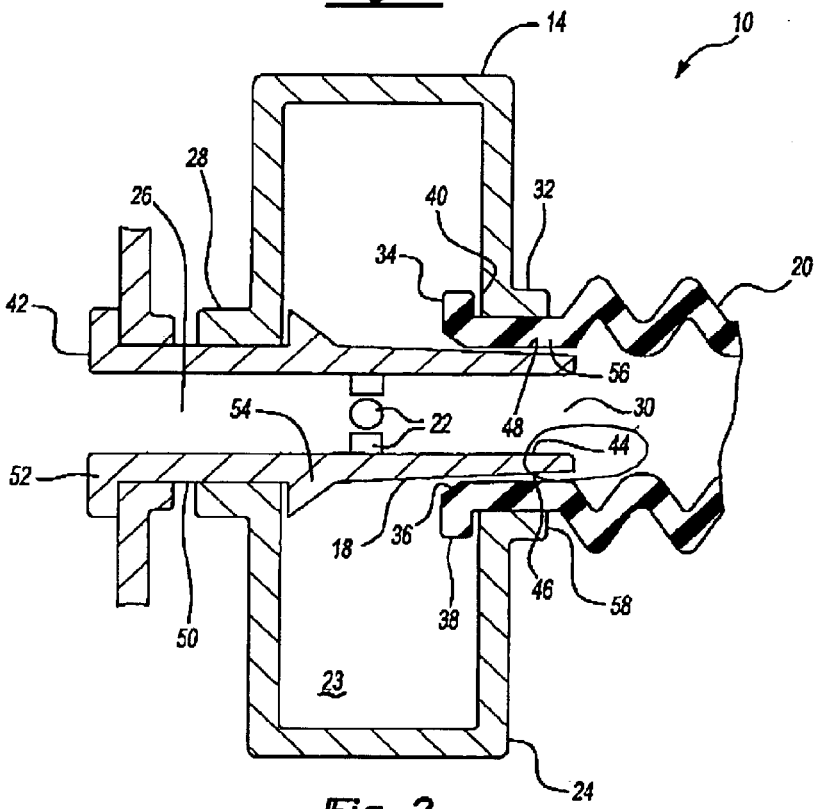
FIG. 2 illustrates the clampless hose retainer mechanism of the present invention.

FIG. 2 illustrates the outer shell 24 of the resonator 14 which includes a tube opening 26 formed by a slightly extended tube neck 28 and a substantially aligned hose opening 30 formed by a slightly extended hose neck 32. The openings 26, 30 are each sized to substantially receive the internal tube 18 and the rubber hose 20, respectively.

When assembled, a first end 34 of the rubber hose 20 is inserted into the hose opening 30. The first end 34 of the rubber hose 20 includes a slightly tapered or angled face 36 and an annular projection 38 extending from the angled face 36. When the first end 34 of the rubber hose 20 is inserted into the hose opening 30, the projection 38 substantially engages an inner wall 40 of the outer shell 24 of the resonator 14.

The rubber hose 20 is sealed and retained in the resonator 14 by the internal tube 18 which passes through the resonator 14. A retention end 42 secures the internal tube 18 to the resonator 14, and a tapered insertion end 44 substantially engages the rubber hose 20 to retain the hose 20 in place. The tapered insertion end 44 includes a sloped surface 46. When the tapered end 44 is inserted into an interior surface 48 of the rubber hose 20, the sloped surface 46 assists with the insertion of the internal tube 18 within the rubber hose 20. Also, the hose is squeezed between the tube 18 and opening 30 to provide a seal.

The retention end 42 includes a recessed portion 50 positioned between a radially inwardly extending flange 54 and a radially outwardly extending flange 52. When assembled, the slightly extended tube neck 28 of the outer shell 24 is positioned in the recessed portion 50, the pair of flanges 52, 54 retaining the tube neck 28 in the recessed portion 50 and the internal tube 18 in place. Rather than a radially outwardly extending flange 52, the outer end could flare outwardly.

The rubber hose 20 is secured to the resonator 14 by the internal tube 18. When the air cleaner assembly 10 is being assembled, the first end 34 of the rubber hose 20 is inserted into the hose opening 30 of the resonator 14 such that the neck 56 of the rubber hose 20 substantially contacts the hose neck 32 of the resonator 14. The internal tube 18 is next inserted into the tube opening 26 of the resonator 14. As the tapered insertion end 44 is inserted within the interior surface 48 of the rubber hose 20, the sloped surface 46 slides along the angled face 36 of the rubber hose 20. If necessary, a lubricant can be added to interior surface 48 of the rubber hose 20. The internal tube 18 expands the rubber hose 20 to form a tight fit and seal with the hose neck 32 of the resonator 14.

When removal of the rubber hose 20 is desired, the internal tube 18 is first released and extracted through the tube opening 26. The rubber hose 20 can then be removed through the hose opening 30.

Figure 3:
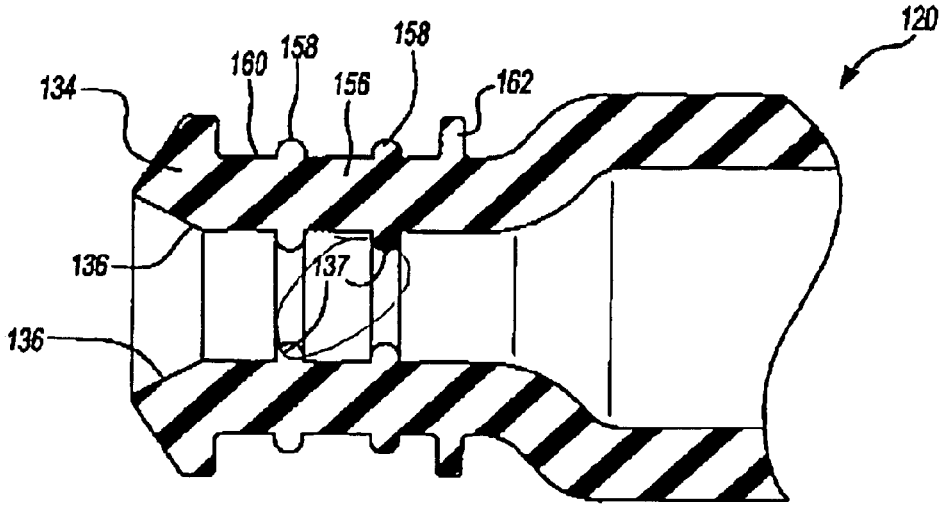
FIG. 3 illustrates an alternative embodiment of the rubber hose of the clampless hose retainer mechanism of the present invention.

In another embodiment of the present invention, the rubber tube 120, as illustrated in FIG. 3, includes a plurality of seal beads 158 positioned on the exterior surface 160 of the neck 156 of the rubber hose 120. The seal beads 158 assist in the sealing of the rubber hose 120 to the hose neck 32 of the resonator 14. Additionally, the rubber hose 120 includes a substantially arrow shaped first end 134 including an angled face 136 which assists with the insertion of the tube 18. An annual retention projection 162 is spaced from the first end 134 at a distance substantially equal to the length of the hose neck 32. Once the rubber hose 120 is positioned within the resonator 14, the retention projection 162 substantially contacts an exterior surface 58 (illustrated in FIG. 2) of the resonator 14, retaining the rubber hose 120 within the resonator 14. Additionally, internal beads 137 can be utilized in the rubber hose 120 to aid in sealing or to provide insertion forces on the tapered insertion end 44.

There are several advantages to utilizing the hose retainer mechanism of the present invention. For one, the hose can be installed without the use of an external metal clamp. Additionally, this assembly facilitates the installation and removal of the hose to the outer shell of the resonator. Finally, this assembly allows for a low number of re-sealings if required and allows for tampered proof sealing.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. An air supply assembly comprising:

a resonator component including a hose opening send a tube opening;

a hose inserted into said hose opening of said resonator component; and a tube inserted into said tube opening of said resonator component, said tube including a tapered end inserted within said hose to seal and retain said hose against said hose opening of said resonator component.

2. The air supply assembly as recited in claim 1 wherein said hose includes an interior surface having an inclined portion.

3. The air supply assembly as recited in claim 2 wherein said tapered end of said tube slides along said inclined portion of said hose during insertion of said tube within said hose.

4. The air supply assembly as recited in claim 1 wherein said tube includes a retention end opposite to said tapered end, and an air cleaner component is attached to said retention end of said tube.

5. The air supply assembly as recited in claim 1 wherein said tube includes a retention end opposite to said tapered end and said retention end includes a recessed portion between a pair of flanges.

6. The air supply assembly as recited in claim 5 wherein a neck of said tube opening of said resonator component engages said recessed portion of said tube to secure said tube to said resonator component.

7. The air supply assembly as recited in claim 1 wherein said hose is connected to an intake manifold component.

8. The air supply assembly as recited in claim 1 further including a plurality of protrusions on an exterior surface of said hose to assist in sealing said hose against said hose opening.

9. The air supply assembly as recited in claim 1 wherein said hose further includes an interior hose projection which substantially contacts an inner surface of said resonator component and secures said hose to said resonator component.

10. The air supply assembly as recited in claim 9 herein said hose further includes an exterior hose projection which an outer surface of said resonator component to secure said hose to said resonator component.

11. The air supply assembly as recited in claim 1 wherein said tube includes a plurality of openings that communicate an interior of said tube into a resonator chamber of said resonator component.

12. An air supply assembly comprising:

a resonator component including a hose opening and a tube opening;

an air cleaner component;

an intake manifold component;

a hose inserted into said hose opening of said resonator component; and a tube inserted into said tube opening of said resonator component, said tube including a tapered end inserted within said hose to seal and retain said hose against said hose opening.

13. The air supply assembly as recited in claim 12 wherein said hose includes an interior surface having an inclined portion.

14. The air supply assembly as recited in claim 13 wherein said tapered end of said tube slides along said inclined portion of said hose during insertion of said tube within said hose.

15. The air supply assembly as recited in claim 12 wherein said tube includes a retention end opposite to said tapered end, and said air cleaner component is attached to said retention end of said tube.

16. The air supply assembly as recited in claim 12 wherein said tube includes a retention end opposite to said tapered end and said retention end includes a recessed portion between a pair of flanges.

17. The air supply assembly as recited in claim 16 wherein a neck of said tube opening of said resonator component engages said recessed portion of said tube to secure said tube to said resonator component.

18. The air supply assembly as recited in claim 12 further including a plurality of protrusions on an exterior surface of said hose to assist in sealing said hose against said hose opening.

19. The air supply assembly as recited in claim 12 wherein said hose further includes an interior hose projection which substantially contacts an inner surface of said resonator component and secures said hose to said resonator component.

20. The air supply assembly as recited in claim 12 wherein said tube includes a plurality of openings that communicate an interior of said tube into a resonator chamber of said resonator component.

21. An air supply assembly comprising:

a resonator component including a hose opening;

a hose inserted into said hose opening, said hose including a plurality of protrusions on an exterior surface of said hose that assists in sealing said hose against said hose opening; and a tube including a tapered end, and said tapered end is inserted within said hose to seal and retain said hose against said hose opening.

22. An air supply assembly comprising:

a resonator component including a hose opening;

a hose inserted into said hose opening, said hose including an interior hose projection which engages an inner surface of said resonator component to secure said hose to said resonator component; and a tube including a tapered end, said tapered end inserted within said hose to seal and retain said hose against said hose opening.

23. An air supply assembly comprising:

a resonator component including a hose opening;

an air cleaner component;

an intake manifold component;

a hose inserted into said hose opening, said hose including a plurality of protrusions on an exterior surface of said hose that assists in scaling said hose against said hose opening; and a tube including a tapered end, said tapered end Inserted within said hose to seal and retain said hose against said hose opening.

24. An air supply assembly comprising:

a resonator component including a hose opening;

an air cleaner component;

an intake manifold component;

a hose inserted into said hose opening, said hose including an interior hose projection which engages an inner surface of said resonator component to secure said hose to said resonator component; and a tube including a tapered end, and said tapered end is inserted within said hose to seal and retain said hose against said hose opening.

* * * * *